US006467146B1

(12) United States Patent
Herman

(10) Patent No.: US 6,467,146 B1
(45) Date of Patent: Oct. 22, 2002

(54) METHOD OF FORMING OF A TUBULAR METAL SECTION

(75) Inventor: Slawomir J Herman, Rochester, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/466,575

(22) Filed: Dec. 17, 1999

(51) Int. Cl.[7] ..... B23P 17/00

(52) U.S. Cl. ..... 29/419.2; 72/56; 72/707; 228/115

(58) Field of Search ..... 29/421.1, 419.2, 29/897; 72/58, 61, 62, 56, 707; 228/115, 234.1, 235.1

(56) References Cited

U.S. PATENT DOCUMENTS 3,187,532 A * 6/1965 Furth ..... 72/56
3,347,074 A * 10/1967 Eilers et al. ..... 72/56
4,331,284 A * 5/1982 Schulz et al. ..... 228/157
4,739,642 A 4/1988 Redman
5,070,717 A * 12/1991 Boyd et al. ..... 29/421.1
5,826,320 A * 10/1998 Rathke et al. ..... 29/419.2
6,301,765 B1 * 10/2001 Arns et al. ..... 29/421.1

* cited by examiner

*Primary Examiner*—Gregory M. Vidovich
*Assistant Examiner*—Jermie E. Cozart
(74) *Attorney, Agent, or Firm*—Ralph E. Smith

(57) ABSTRACT

A process for forming closed sections using electromagnetic force. A sheet metal stock is folded into a generally closed section having flanges. The folded section is placed in a die and the die is closed. An electromagnetic force is applied to the die to expand the sheet metal towards interior walls of the die, thereby forming the closed section to a predetermined shape. During expansion, the flanges are drawn inward toward the die. After removed from the die, excess flanges are trimmed from the section if needed, the sections welded closed.

4 Claims, 2 Drawing Sheets

METHOD OF FORMING OF A TUBULAR METAL SECTION

FIELD OF THE INVENTION

The present invention relates generally to forming closed tubular structures, and more particularly to using folded sheet stock having flanges welded prior to placement within a die to provide a predetermined shape.

BACKGROUND

In a typical metal forming operation in which closed sections are formed, conventional methods utilize either a combination of a stamping and a welding process of sheet metal to form the closed tubular section or a hydroforming process. In the stamping/welding process, two portions of the closed section are stamped individually from the sheet metal. The two portions are then aligned and welded to form the closed tubular section. Such, a process, however, leaves a tubular section having two welds, which provides a greater opportunity for heat deformation requires metal and reduction techniques.

In a hydroforming process, the tubular member is folded, welded, and placed in a die. Fluid pressure is then applied within the interior of the tubular member, causing the tubular member to expand to fill the die. In the hydroform process, however, expansion is typically limited to 25 to 30%. This limitation of expansion causes a corresponding limitation in the variability of the cross-section over the length of the tubular member. Thus, it is desirable to provide an improved process for forming tubular members.

It is also desirable to provide a process at which results in the formation of a tubular member having a cross-section along its length that can be varied, which is welded on only one seam, and which has minimal sharp surfaces.

SUMMARY OF THE INVENTION

This invention is directed to a process for forming a tubular metal section in a predetermined shape. The process includes providing sheet metal and folding the sheet metal to form a generally open tube with a pair of opposing flanges. the opposing flanges are welded at various, predetermined locations along the flanges. The welded sheet meal is placed into a die formed to the predetermined shape, and the sheet metal is expanded within the die outwardly toward the die to form the tubular metal section in the predetermined shape.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
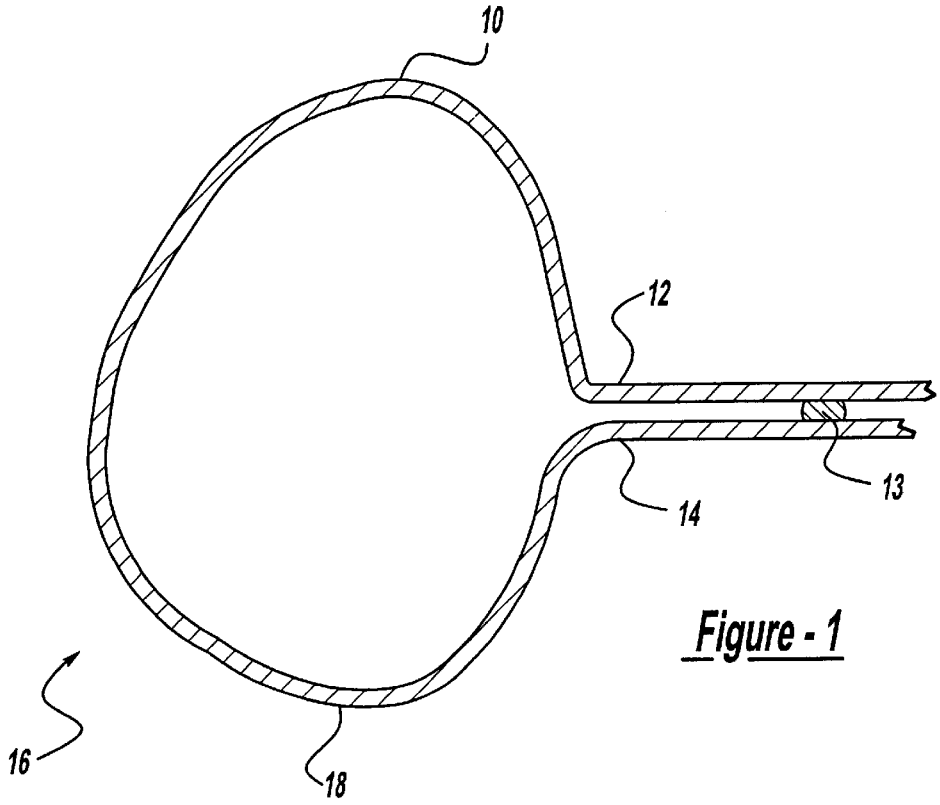
FIG. 1 is a cross-section of folded sheet metal.
Figure 2:
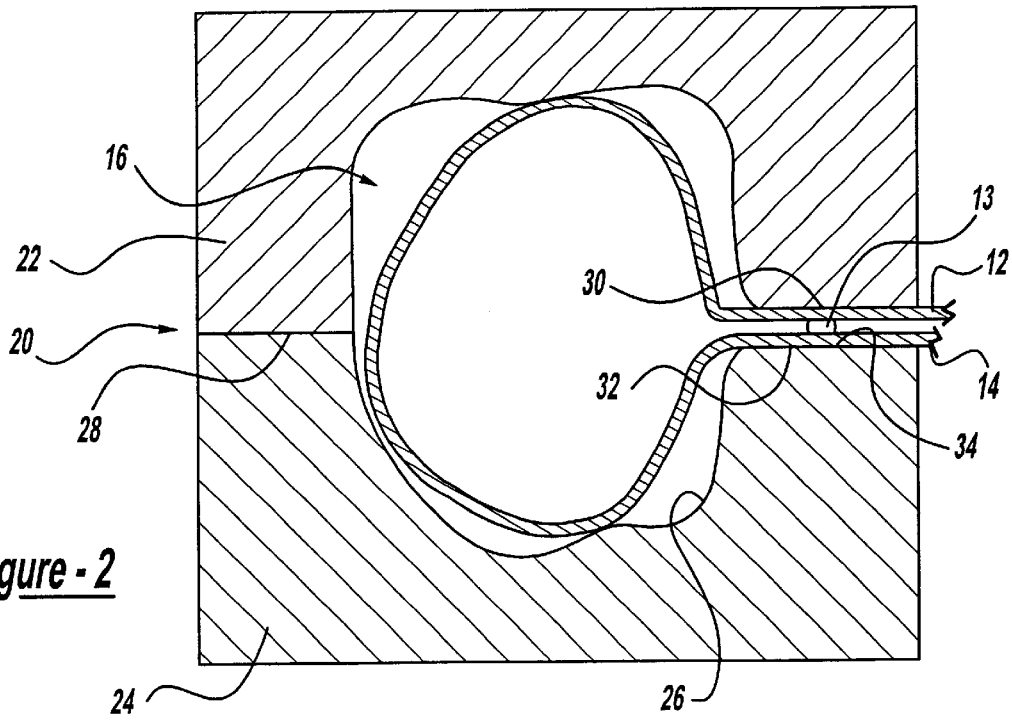
FIG. 2 is a cross-section of folded sheet metal placed within the die arranged in accordance with the principles of the present invention.

The present invention will be described with respect to FIGS. 1–4. With particular respect to FIG. 1, sheet metal 10 is folded into a generally closed tubular section having a first flange 12 and a second flange 14. Sheet metal 10 may be folded into folded section 16 using any number of devices known in the art for folding sheet metal. Flanges 12, 14 are continuously or spot welded along weld seam 13. Weld seam 13 joins flanges 12, 14 at various points to vary the cross-section of the formed parts.

Folded sheet metal section 16 is inserted within a die 20. Die 20 includes a pair of opposed die sections 22 and 24. Die sections 22 and 24 cooperate to form a generally closed interior cavity 26. Interior cavity 26 is formed into a predetermined shape which may vary along the axial length of the formed section in accordance with the desired predetermined shape in which the closed tubular section will be formed. Die sections 22, 24 abut tightly to form a first seam 28. Opposite seam 28, die sections 22, 24 include a pair of opposing edges 30, 32. Opposing edges 30, 32 do not tightly abut as do opposing edges that define seam 28. Rather, opposing edges 30, 32 define an opening 34. Opening 34 receives flanges 12, 14 of folded section 16.

Upon insertion and securement of folded section 16, an electromagnetic force is generated by energizing conductor. The electromagnetic force causes circular section 18 of folded section 16 to expand towards the inner walls or inner cavity 26 of die 20. During expansion, the flanges 12, 14 are pulled inward towards interior cavity 26 to form folded section 16 into the predetermined shape. The weld seam limits how far inward flanges 12, 14 can be pulled inward, along the length of folded section 16, thereby determining the shape of the expanded section along the length of folded section 16.

Alternatively, rather than using electromagnetic force to expand folded section 16, fluid pressure can be applied to the interior folded section 16. To accomplish fluid pressure expansion, the flanges are continuously welded to create a sealed seam. The fluid pressure applied to the interior of folded section 16 expands folded section 16 to fill interior cavity 26 of die 20. As describe above, the weld seam placed between flanges 12, 14 variably control expansion along the length of folded section 16.

Figure 3:
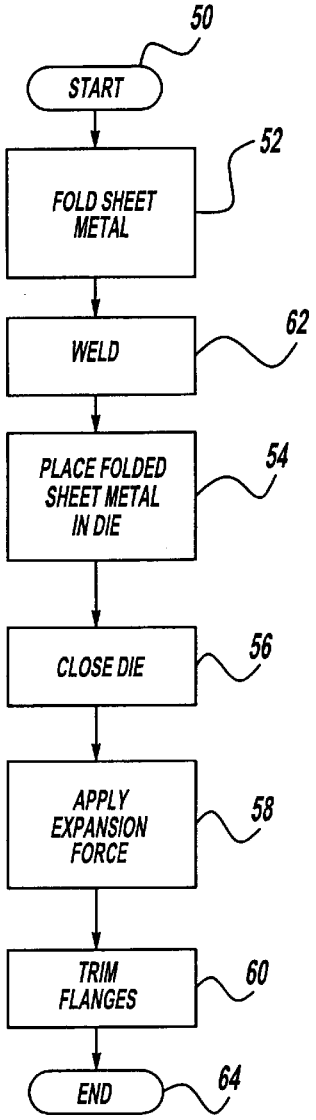
FIG. 3 is a flow diagram of the tubular section forming operation according to the principles of the present invention.

FIG. 3 depicts a flow diagram of the process of forming the predefined tubular sections. The process begins at start block 50 and proceeds to process block 52. Process block 52 folds the sheet metal into the above-described tubular section including the above-described flanges. At process block 62, flanges 12, 14 are welded to provide the predetermined shape of the formed section. Control next proceeds to process block 54 which places the folded sheet metal in the die. Control next proceeds to process block 56 where the die is closed and the flanges are placed between an opening between a pair of opposing edges of the die sections. Control next proceeds to process block 58 which applies the expansion force to the folded section in order to expand the folded section towards the interior cavity of the die. At process block 60, after the shaped section has been removed from the die, the excess flange material is trimmed away from the shaped section to leave a closed tubular section.

Figure 4:
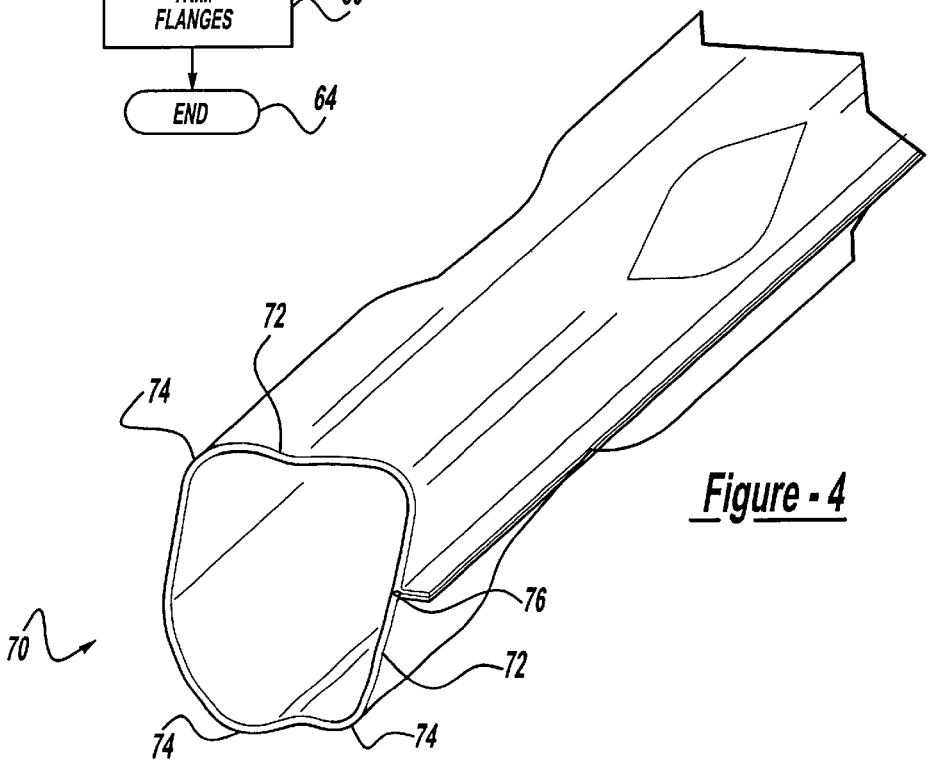
FIG. 4 is a perspective view of the resultant tubular section formed by the present invention.

FIG. 4 depicts a perspective view of tubular section 70 formed by the present invention. As shown, tubular section 70 is primarily a closed section, having a plurality of walls 72 and curved sections 74 and a small weld flange. The section is closed via a spot or continuous weld seam 76.

One skilled in the art will recognize that any of a number of predetermined shapes may be formed of the tubular sections according to the present invention. Further, one skilled in the art will recognize that the present invention provides substantial benefit of eliminating of existing manufacturing process.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of forming a tubular metal section in a predetermined shape comprising the steps of:

folding a metal sheet to form a generally open tube with a pair of abutting flanges;

welding the folded metal along the abutting flanges;

placing the folded metal into a die formed to the predetermined shape; and generating an electromagnetic force to expand the metal within the die outwardly toward the die to form the tubular metal section in the predetermined shape, wherein the abutting flanges are welded at positions arranged to control outward expansion of the sheet metal within the die.

2. The method of claim 1 further comprising the step of trimming the flanges after the folded metal has been formed to the predetermined shape.

3. The method of claim 1 wherein the step of placing the folded metal into the die further comprises the step of placing the flanges between opposing edges of the die.

4. The method of claim 3 wherein the step of expanding the metal draws the flanges inward toward the die.

* * * * *